US011472515B2

(12) United States Patent
Weisenburger

(10) Patent No.: US 11,472,515 B2
(45) Date of Patent: Oct. 18, 2022

(54) SURFBOARD WITH OVERLAP

(71) Applicant: WBV Weisenburger Bau+Verwaltung GMBH, Rastatt (DE)

(72) Inventor: Nicolai Weisenburger, Baden-Baden (DE)

(73) Assignee: WBV Weisenburger Bau+Verwaltung GmbH, Rastatt (DE)

( * ) Notice: Subject to any disclaimer, the term of this patent is extended or adjusted under 35 U.S.C. 154(b) by 0 days.

(21) Appl. No.: 16/956,563

(22) PCT Filed: Dec. 20, 2018

(86) PCT No.: PCT/EP2018/086146

§ 371 (c)(1),
(2) Date: Jun. 20, 2020

(87) PCT Pub. No.: WO2019/122098

PCT Pub. Date: Jun. 27, 2019

(65) Prior Publication Data

US 2021/0024180 A1 Jan. 28, 2021

(30) Foreign Application Priority Data

Dec. 21, 2017 (DE) ..... 102017130959.4

(51) Int. Cl.

| | |
|---|---|
| ***B63B 32/51*** | (2020.01) |
| ***B63B 32/10*** | (2020.01) |
| ***B63B 32/40*** | (2020.01) |
| ***B63B 32/77*** | (2020.01) |
| ***B63B 32/53*** | (2020.01) |
| ***B63B 32/57*** | (2020.01) |

(52) U.S. Cl.

CPC ..... *B63B 32/51* (2020.02); *B63B 32/10* (2020.02); *B63B 32/40* (2020.02); *B63B 32/53* (2020.02); *B63B 32/57* (2020.02); *B63B 32/77* (2020.02)

(58) Field of Classification Search

CPC ..... B63B 32/00; B63B 32/10; B63B 32/20; B63B 32/22; B63B 32/40; B63B 32/50; B63B 32/51; B63B 32/53; B63B 32/55; B63B 32/57; B63B 32/64; B63B 32/66; B63B 32/70; B63B 32/77; B63B 32/80

See application file for complete search history.

(56) References Cited

U.S. PATENT DOCUMENTS 5,255,625 A * 10/1993 Hattori ..... B63B 34/10 114/248
5,388,544 A * 2/1995 Kobayashi ..... B63B 27/24 114/248
2015/0086337 A1 3/2015 Railey

FOREIGN PATENT DOCUMENTS

CN 205675195 U 11/2016
CN 205952254 U 2/2017
DE 202011051071 U1 11/2011

(Continued)

*Primary Examiner* — Ajay Vasudeva
(74) *Attorney, Agent, or Firm* — Bay State IP, LLC

(57) ABSTRACT

The invention relates to an inflatable surfboard having a hull component (2) with a receptacle (4) at the stern end, a drive unit (3) which fits into the receptacle (4) at the stern end in a positively locking manner, and a gap (6) on the underwater surface between the hull component (2) and the drive unit (3), wherein an overlap (8) which covers the gap (6) at least in some sections is arranged on an underwater surface (7) of the hull component (2).

6 Claims, 6 Drawing Sheets

(56) References Cited

FOREIGN PATENT DOCUMENTS

Figure 1:
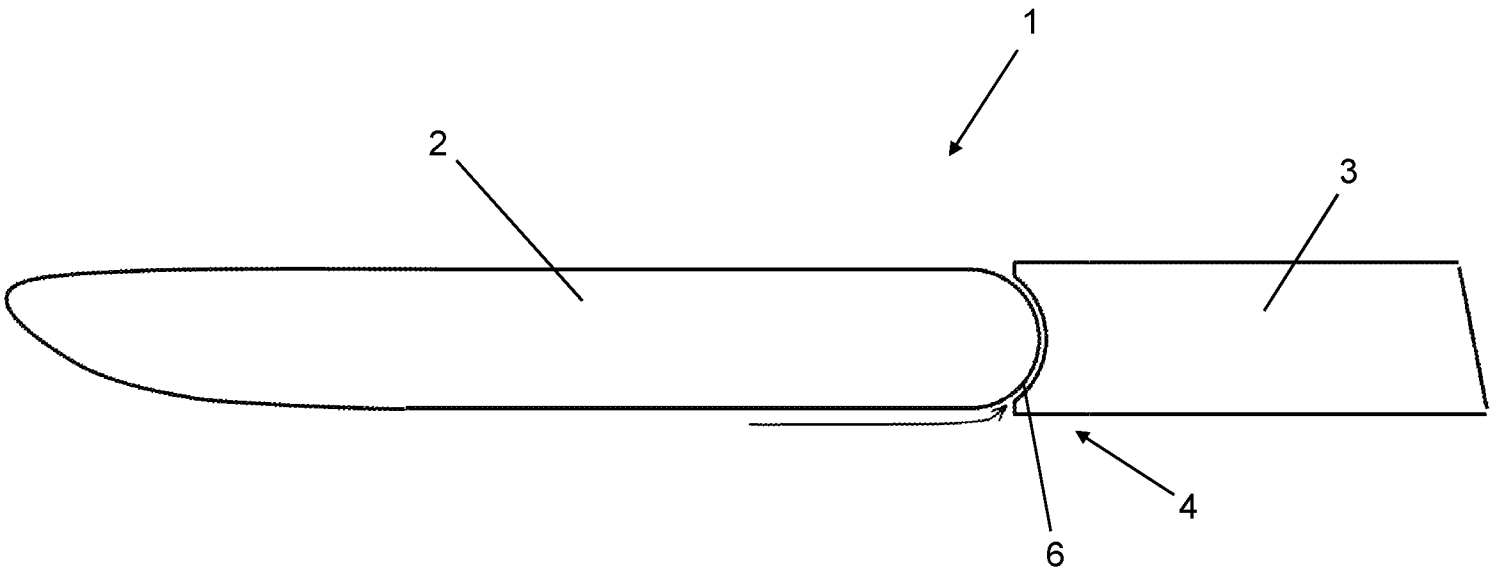

| | | | | |
|---|---|---|---|---|
| DE | 102015103503 | A1 | 4/2016 | |
| DE | 102015108863 | A1 | 12/2016 | |
| DE | 202015009474 | U1 | 10/2017 | |
| JP | 2002193185 | A | 7/2002 | |
| JP | 2003026085 | A | 1/2003 | |
| WO | WO-2018149044 | A1 * | 8/2018 | ..... B63B 32/10 |

* cited by examiner

SURFBOARD WITH OVERLAP

CROSS REFERENCE TO RELATED APPLICATION

This application is for entry into the U.S. National Phase under § 371 for International Application No. PCT/EP2018/086146 having an international filing date of Dec. 20, 2018, and from which priority is claimed under all applicable sections of Title 35 of the United States Code including, but not limited to, Sections 120, 363, and 365(c) and which in turn claims priority under 35 USC 119 to German Patent Application No. 102017130959.4 filed on Dec. 21, 2017.

The invention relates to a surfboard having a hull component with a receptacle at the stern end, a drive unit which fits into the receptacle at the stern end in a positively locking manner and a gap between the hull component and the drive unit on the underwater surface.

Inflatable surfboards with a drive unit are known in the prior art for example from DE 10 2015 103 503.0. The known surfboard has an inflatable hull component with a recess at the stern end as well as a drive unit which fits into the recess at the stern end in a positively locking manner and is inserted into it. A gap on the underwater surface is formed between the drive unit and the hull component. The surfboard driven by the drive unit can reach considerable speeds of 25 knots and more during the ride. This results in a water current along the underwater surface of the surfboard and a water pressure on the underwater surface of the surfboard which forces water into the gap. As a result the positively locking connection between the hull component and the drive unit is loosened, so that the water resistance of the board is unnecessarily increased and the positive locking is significantly impaired.

DE 10 2015 103 863 A1 discloses a surfboard having a two-part drive component which can be releasably fastened at the stern end to an inflatable hull component by fastening means. The contours of the two-part drive component and of the hull component are adapted to one another in a complementary manner. This has fundamentally the same problems as the aforementioned prior art.

It is an object of the present invention to provide an inflatable surfboard which avoids or at least reduces the above-mentioned disadvantages.

This object is achieved by a surfboard referred to in the introduction with the features of claim 1.

Preferred embodiments are the subject matter of the subordinate claims.

The surfboard according to the invention comprises a hull component with a recess at the stern end, a drive unit which fits into the recess at the at the stern end in a positively locking manner and is preferably already inserted into it, and a gap on the underwater surface between the hull component and the drive unit, wherein an overlap which covers at least sections of the gap is arranged on the underwater surface of the hull component.

It has been shown that the ingress of water into the slot can be effectively reduced if an overlap which covers at least sections of the gap is arranged on the underwater surface of the hull component. It is not absolutely necessary to achieve a watertight closure relative to the surrounding water. However, the function of the overlap is that during the ride, that is to say when a water current forms along the underwater surface of the surfboard, this water current can no longer penetrate into the gap, but is led away along the underwater surface via the gap. Thus the penetration of water into the gap is largely prevented, and in addition a slight suction effect can take place at the open end of the overlap, which to some extent even sucks out the water located in the gap.

The hull component advantageously has two lateral arms which preferably engage in a U shape around the drive unit. The overlap is adapted to the configuration of the gap, and the overlap therefore likewise has a U-shaped configuration and covers at least the section of the gap at the bow end. In the past, most water penetrated into the gap in the section of the gap arranged transversely, preferably perpendicularly with respect to the direction of travel at the bow end. This can be effectively prevented. The expression "U-shaped" should be understood in general terms here. However, a U shape should be understood as strictly a U shape but also a dish shape, a rectangular shape or the like.

The hull component is preferably designed to be inflatable. In particular, with inflatable hull components, the penetration of water into the gap leads to a widening of the gap and an increase in the drag, because the hull component yields to some extent under the pressure of the penetrating water.

The hull component can be made from a drop stitch material and is firmly inflatable. The lateral walls of the hull component have a rounded outwardly projecting configuration, that is to say a convex configuration. This convex shape of the hull component forms more or less automatically as a result of air being introduced at high pressure into the hull component. The peripheral lateral walls of the drive unit correspondingly have a concave configuration. The width and length of the drive unit are chosen so that it fits into the recess in a positively locking manner. In spite of precise adaptation of the lateral walls of the drive unit to the inflated hull component, nevertheless a gap forms in particular exactly on the underwater surface between the hull component and the drive unit. Water is forced into this gap during the ride.

In particular a section of the gap extending transversely in the direction of travel is covered according to the invention by the overlap. The overlap preferably covers the entire transversely extending section of the U-shaped gap and covers at least part of the U-shaped lateral branches of the gap. The overlap on the edge remote from the recess is preferably connected as smoothly as possible to the underwater surface of the hull component, that is to say for example chamfered, and is glued or sewn directly on the edge, in particular the leading edge in the direction of travel of the surfboard so that, even in the event of a relatively strong current, water cannot penetrate between the leading edge of the overlap and the hull component and advantageously the water resistance of the board is not increased by the edge.

In a further favourable embodiment of the invention a releasable fastening means is arranged between an inner side of the overlap facing the drive unit and the underwater surface of the drive unit.

Here and in what follows, "inner" relates to the orientation towards the drive unit or towards the U-shaped recess. On the side of the overlap facing the drive unit a releasable connection, for example a hook-and-loop fastener, can be arranged along an inner side of the overlap, and interacts with a hook-and-loop fastener counterpart arranged on the underwater surface of the drive unit, so that the overlap is also additionally fastened at least releasably to the drive unit. As a result the penetration of water can be further reduced and the danger of increasing the water resistance of the board by the overlap can likewise be reduced.

In order that a minimal additional flow resistance is produced and the overlap covers the gap as favourably as possible, at least one fastening line is provided between the overlap and the hull component, wherein advantageously a nominal dimension of the fastening line of the hull component is greater than a nominal dimension of the fastening line of the overlap. Thus the fastening lines of the hull component and the overlap are not exactly identical, but because the fastening line of the hull component is somewhat greater than that of the overlap, an insertion of the drive unit into the hull component at the outset in the non-inflated state is easily possible, and the overlap is spanned smoothly when the hull component is firmly inflated. In this way creasing is counteracted.

The overlap is preferably open towards the stern end. The overlap which is open towards the stern end has the advantage that an at least slight Bernoulli effect can be produced due to the water current flowing along the overlap and past the drive component and also more or less draws water out of the gap.

Figure 2:
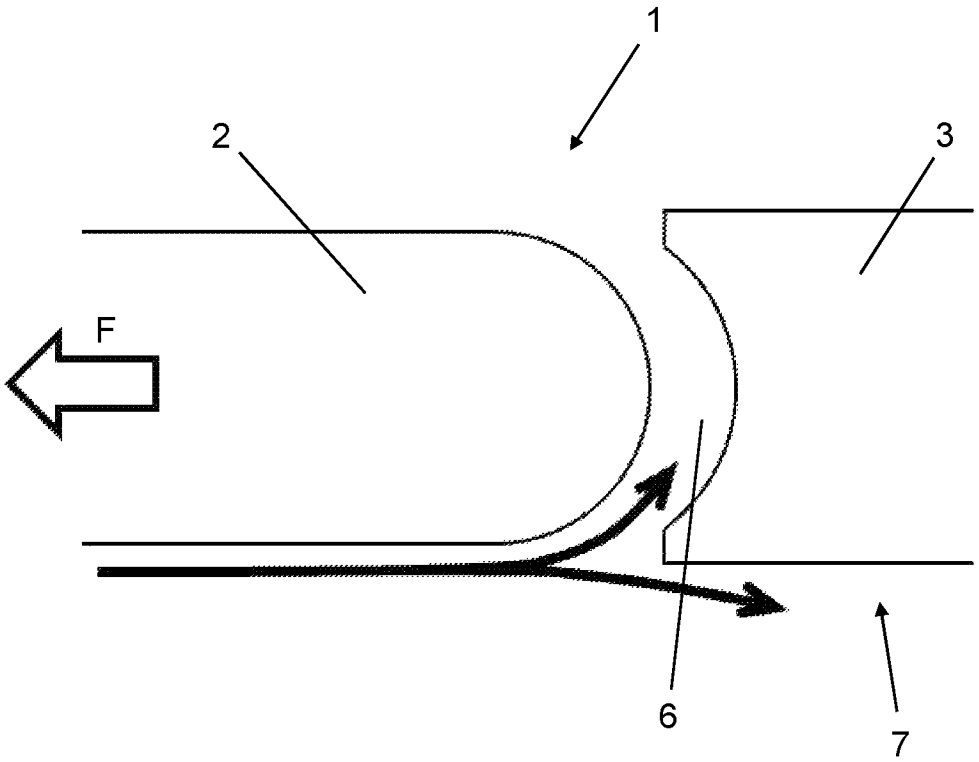
Figure 3:
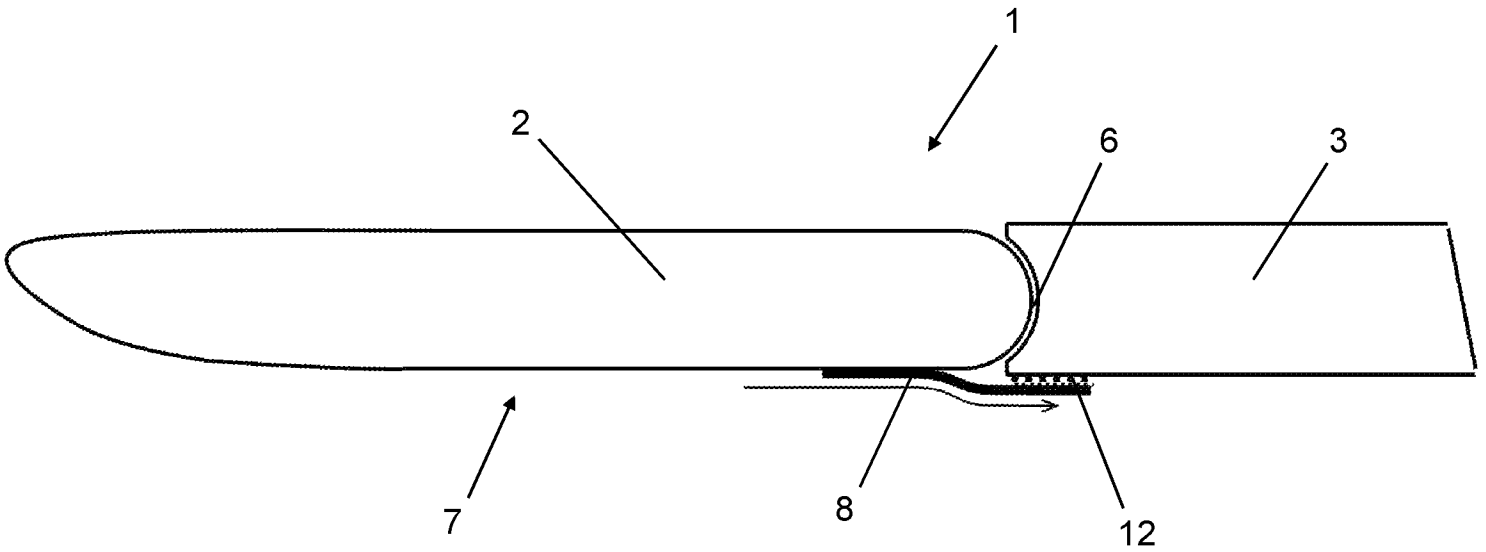
Figure 4:
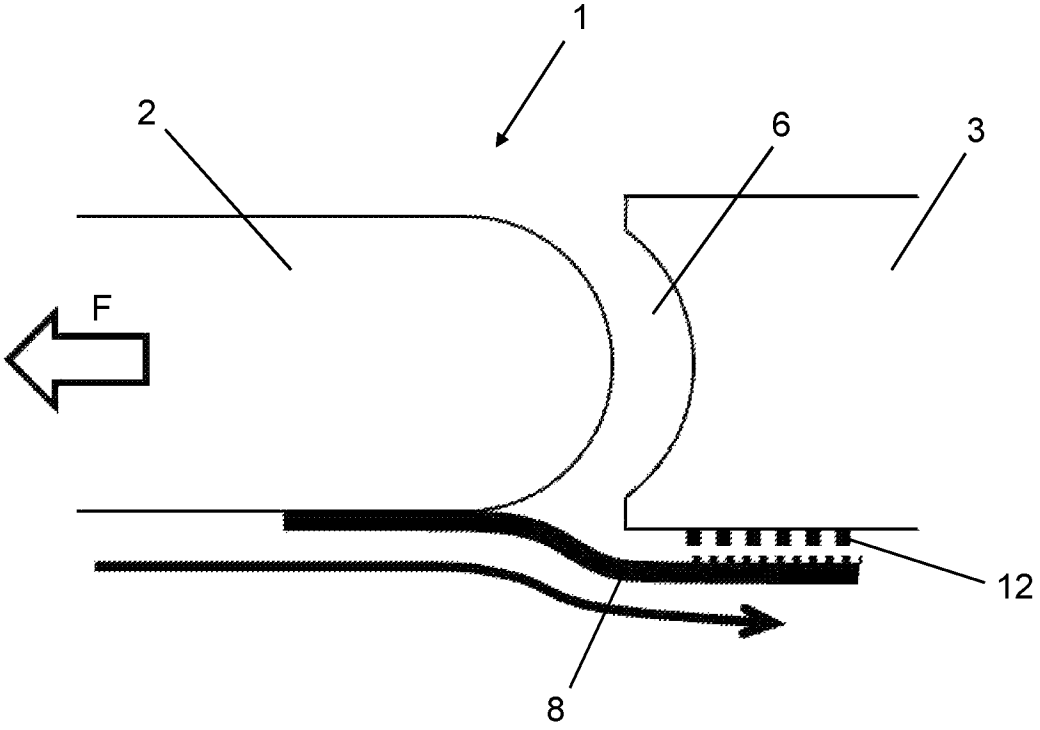
Figure 5:
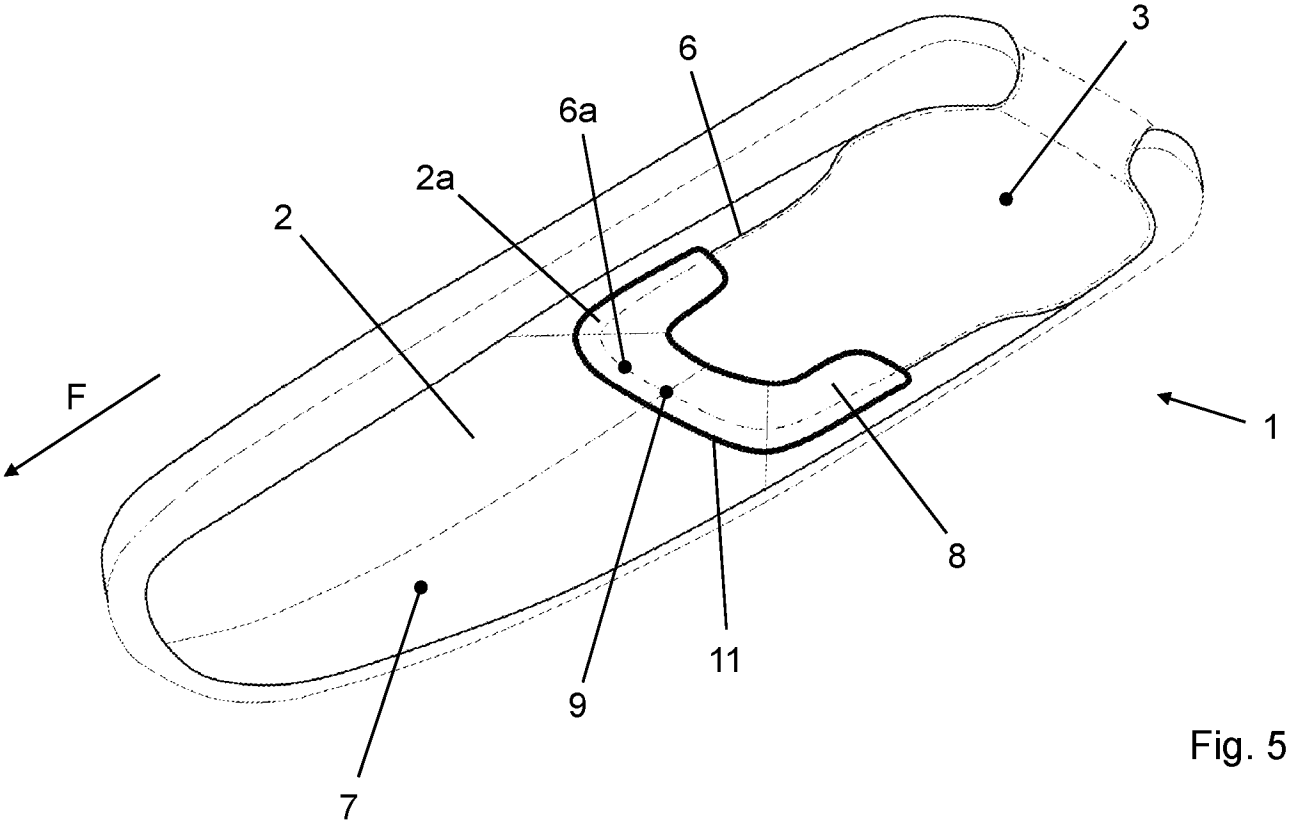
Figure 6:
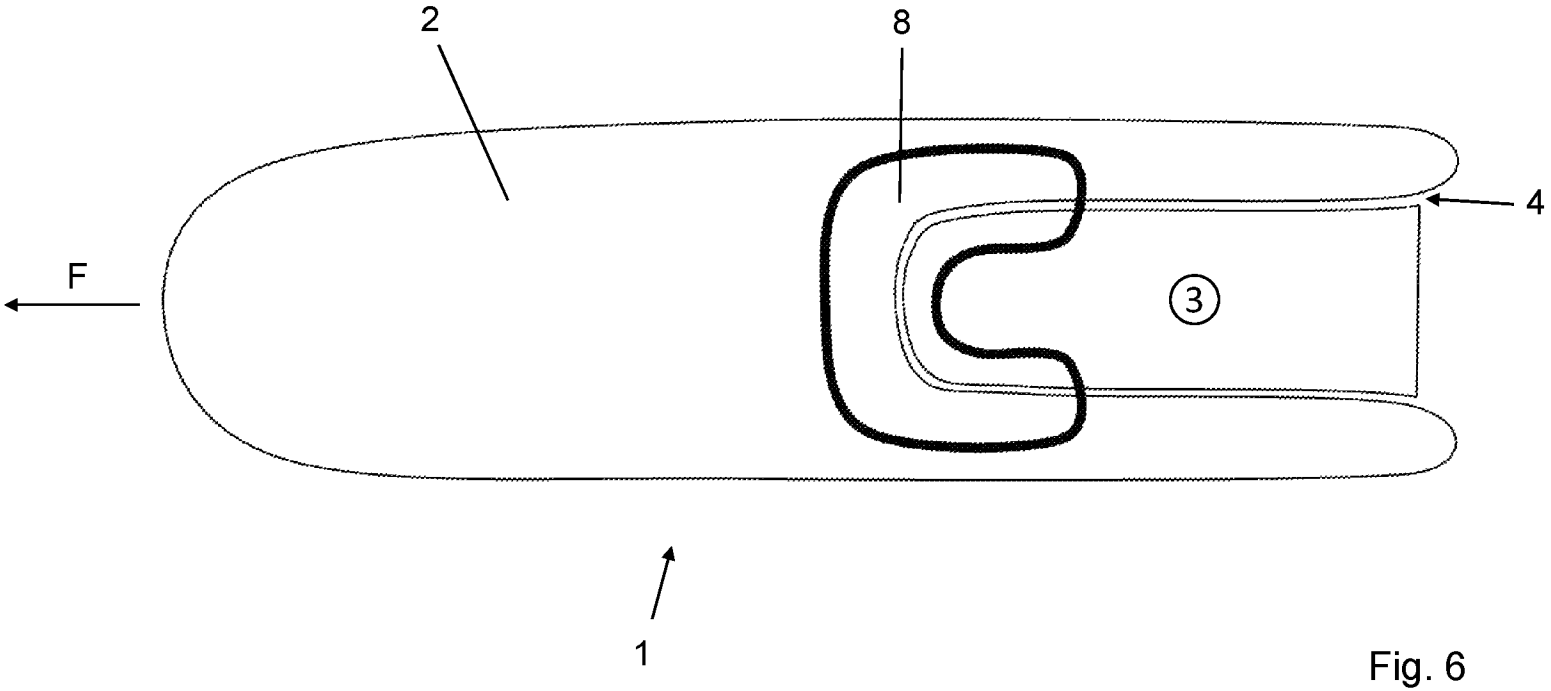

The invention is described with reference to an embodiment in six drawings. In the drawings:

FIG. 1 shows a schematic sectional view of a conventional surfboard,

FIG. 2 shows a view of a detail of the gap between the hull component and the drive unit, FIG. 3 shows a sectional view according to FIG. 1 of the surfboard according to the invention with the overlap, FIG. 4 shows a view of a detail of FIG. 3, FIG. 5 shows a view from below of the surfboard according to the invention with the overlap between the hull component and the drive unit, FIG. 6 shows a view of the surfboard according to the invention with the overlap.

FIG. 1 and FIG. 2 show surfboards 1 according to the prior art. The surfboard 1 has a hull component 2 which is inflatable. In a view from above the hull component 2 is substantially U-shaped in a stern section. A drive unit 3 is introduced into a U-shaped receptacle 4 of the hull component 2.

The hull component 2 can preferably be made from a drop stitch material. The drop stitch material is produced by the drop stitch method, wherein two or more synthetic fabric webs, preferably denier polyester fabric webs, are laid one above the other. The two synthetic fabric webs are connected to one another by a plurality, i.e. thousands, of polyester threads. In this case the maximum spacing of the two fabric webs is fixed, so that the space between the fabric webs which is filled with polyester can be filled later with compressed air and the fabric webs are then substantially parallel to one another. The polyester threads are sewn on both sides to the two fabric webs, for example with the aid of a drop stitch sewing machine. The two fabric webs which are sewn to one another form the support structure which gives the hull component 2 its mechanical strength in the inflated state.

The two fabric webs which are connected to one another are cut to the required shape. The upper and the lower fabric webs are preferably coated with PVC layers, preferably with three layers, and are pressed and glued in layers. The faces are glued, overlapping, to the seam strip and are pressed, so that the airtight hull component 2 is produced.

The drop stitch method makes it possible to produce the inflatable hull component 2 with outstanding mechanical strength properties, which withstand not only tensile loads but also compressive loads and shearing loads. The drop stitch outer skin of the inflatable hull component 2 is airtight and in the inflated state is exceptionally resistant to deformation, so that a surfer can stand and surf on the hull component 2 whilst retaining the external shape of the inflated hull component 2. The inflatable hull component 2 is filled with air under high pressure. The filling can take place by means of an air pump or a compressor. The compressor can be supplied with electrical power by batteries incorporated in the surfboard 1.

The hull component 2 made from the drop stitch material is preferably sound-damping, so that the volume of sound generated by the breaking of waves, but also by the drive, is damped by the hull. The hull component 2 is subject to little vibration during operation, because vibrations are reduced by the drop stitch material. Since the hull component 2 is somewhat deformable, impacts and waves etc. are advantageously absorbed. Furthermore, by comparison with conventional surfboards 1 it is advantageous that the softer hull causes fewer injuries, for example if the surfboard 1 collides with the surfer in the event of the surfer falling off.

The stern region of the hull component 2 includes the receptacle 4 for the drive unit 3. The drive unit 3 can comprise a jet drive. The jet drive comprises an opening for the water inlet on an underwater surface 7 of the drive unit 3 as well as a water channel towards the stern end surface of the drive unit 3. The water outlet can be formed there by a nozzle. The nozzle can be arranged pivotably or fixed.

In the water channel a rotor is provided which, due to its high rotational speed in operation, draws water into the water channel and sprays it out rearwards through the nozzle and thus gives the surfboard 1 the propulsion. The rotor is connected by means of a drive train to a motor, preferably an electric motor which is optionally controllable by means of a controller and is supplied with power by means of the battery. The drive unit 3 as a whole is replaceable. The term "rotor" should be understood broadly here. It may be a propeller, an impeller or the like.

A gap 6 is produced between the drive unit 3 and the hull component 2. Since the hull component 2 has a convex configuration into the receptacle 4 along a lateral inner wall running around about three-quarters of the drive unit 3, an outer periphery of the drive unit 3 is adapted in a positively locking manner to this contour, but this adaptation may never be so exact that no gap 6 is produced, in particular not directly on the underwater surface 7, on the joint between the hull component 2 and the drive unit 3. In the illustration in FIG. 2 the width of the gap 6 is exaggerated. However, the problem is discernible that during the ride on the surfboard 1 water is really forced into the gap 6 due to the flow speed. The current of water is illustrated by the longer arrows. A direction of travel F of the surfboard 1 is illustrated by a broad arrow.

FIG. 3 shows the surfboard 1 according to the invention which has an overlap 8 on the underwater surface 7. The overlap 8 is a flap made from PVC, PE, PET or another plastic material, which is likewise U-shaped in a view from above substantially according to FIG. 5 and covers the gap 6 at least in some sections. However, the overlap 8 can also be made from leather or other natural materials or also a metal foil. The overlap 8 is in particular provided at a gap section **6*a* which is arranged transversely in the direction of travel F, and is located between a leading edge of the drive unit 3 in the direction of travel F and a corresponding, transversely arranged inner wall 2*a* of the hull component 2, and completely overlaps the transversely extending gap section 6*a*. The flap 8 is firmly sewn, glued or welded to the hull component 2. For this purpose a welded, glued or sewn seam 9 is provided, or a plurality of welded, glued or sewn seams 9 are provided, which follow(s) the edge 11 of the overlap 8 remote from the receptacle 4. The edge 11 which runs ahead of the overlap 8 in the direction of travel F or runs at the side thereof is preferably chamfered in the direction of travel F and glued to the hull component 2 along the entire edge 11 so that, even during the ride through the water current no water can penetrate between the underwater surface 7 of the hull component 2 and the overlap 8, but the water current according to FIG. 4 is deflected below the flap. The overlap 8 can be releasably connected to the drive unit 3 in a section which overlaps with the drive unit 3; in this connection a hook-and-loop fastener 12 according to FIG. 3 or the like can be formed between the edge of the overlap 8 facing the drive unit 3 and the drive unit 3** itself.

The overlap 8 preferably rests closely and without creases on the underwater surface 7 of the drive unit 3.

FIG. 6 shows the overlap 8 in a view from below. The view from below shows the U-shaped receptacle 4 which is formed by the hull component 2. Inflatable arms of the hull component 2, which are circular in cross-section perpendicular to the direction of travel F, and which between them engage around the drive unit 3, are arranged laterally on the drive unit 3. On the forward part of the drive unit 3 in the direction of travel F the overlap 8 is provided which is connected to the hull component 2 and which does not necessarily completely cover the gap 6, but completely covers the gap section 6*a* which extends transversely, preferably perpendicularly to the direction of travel F and into which a particularly large amount of water has penetrated.

LIST OF REFERENCE NUMERALS

1 surfboard
2 hull component
2*a* inner wall
3 drive unit
4 receptacle
6 gap
6*a* gap section
7 underwater surface
8 overlap
9 welded or sewn seam, fastening line
11 edge
12 hook-and-loop fastener
F direction of travel

The invention claimed is:

1. A Surfboard comprising:
a hull component (2) with a receptacle (4) at a stern end,
a drive unit (3) which fits into the receptacle (4) at the stern end in a positively locking manner,
a U-shaped gap (6) on an underwater surface (7) between the hull component (2) and the drive unit (3),
an overlap (8) which covers the gap (6) at least in some sections is arranged on the underwater surface (7) of the hull component (2)
characterized in that the overlap (8) is adapted to the configuration of the gap (6) and the overlap (8) is formed as a U-shape stripe and is a flap.

2. Surfboard according to claim 1, characterised in that the hull component (2) is inflatable.

3. Surfboard according to claim 1, characterised in that the hull component (2) has two lateral arms which engage in a U shape around the drive unit (3), and the overlap (8) is likewise U-shaped and at least covers a section of the gap (6) at a bow end.

4. Surfboard according to claim 1, characterised in that a releasable fastening means is arranged between an inner side of the overlap (8) and the underwater surface (7) of the drive unit (3).

5. Surfboard according to claim 1, characterised in that the overlap (8) is open towards the stern end.

6. Surfboard according to claim 1, characterised in that on a leading edge in a direction of travel (F) the overlap (8) is chamfered towards the underwater surface (7).

* * * * *